US011286643B2

(12) United States Patent
Ku

(10) Patent No.: US 11,286,643 B2
(45) Date of Patent: Mar. 29, 2022

(54) HYDRAULIC CIRCUIT FOR CONSTRUCTION EQUIPMENT

(71) Applicant: VOLVO CONSTRUCTION EQUIPMENT AB, Eskilstuna (SE)

(72) Inventor: Bon Seuk Ku, Gyeongsangnam-do (KR)

(73) Assignee: VOLVO CONSTRUCTION EQUIPMENT AB, Eskilstuna (SE)

( * ) Notice: Subject to any disclaimer, the term of this patent is extended or adjusted under 35 U.S.C. 154(b) by 0 days.

(21) Appl. No.: 17/271,117

(22) PCT Filed: Aug. 30, 2018

(86) PCT No.: PCT/KR2018/010094
§ 371 (c)(1),
(2) Date: Feb. 24, 2021

(87) PCT Pub. No.: WO2020/045706
PCT Pub. Date: Mar. 5, 2020

(65) Prior Publication Data

US 2021/0246633 A1 Aug. 12, 2021

(51) Int. Cl.
*E02F 9/22* (2006.01)
*F15B 21/14* (2006.01)
(Continued)

(52) U.S. Cl.
CPC ..... *E02F 9/2217* (2013.01); *E02F 9/2292* (2013.01); *F15B 1/024* (2013.01); *F15B 11/024* (2013.01); *F15B 21/14* (2013.01); *E02F 9/2267* (2013.01); *F15B 2211/20576* (2013.01); *F15B 2211/3058* (2013.01); *F15B 2211/625* (2013.01); *F15B 2211/7741* (2013.01)

(58) Field of Classification Search
None
See application file for complete search history.

(56) References Cited

U.S. PATENT DOCUMENTS 5,331,882 A 7/1994 Miller
6,092,454 A 7/2000 Vande Kerckhove
(Continued)

FOREIGN PATENT DOCUMENTS

WO WO 2016/169936 A1 10/2016

OTHER PUBLICATIONS

International Search Report and Written Opinion of the International Searching Authority, PCT/KR2018/010094, dated May 27, 2019, 8 pages.

*Primary Examiner* — Michael Leslie
(74) *Attorney, Agent, or Firm* — Sage Patent Group

(57) ABSTRACT

Provided is a hydraulic circuit of construction equipment, including a boom cylinder for controlling ascending and descending movement of a boom, which includes a valve unit having a first control valve configured to control a large chamber of the boom cylinder to selectively communicate with a small chamber of the boom cylinder, a second control valve configured to control the large chamber to selectively communicate with an oil tank, a third control valve configured to control the large chamber to selectively communicate with an accumulator, and a fourth control valve configured to control a part of hydraulic oil flowing to the accumulator to selectively flow to an assist motor.

7 Claims, 7 Drawing Sheets

(51) Int. Cl.
*F15B 1/02* (2006.01)
*F15B 11/024* (2006.01)

(56) References Cited

U.S. PATENT DOCUMENTS

| | | | | |
|---|---|---|---|---|
| 6,502,393 | B1 * | 1/2003 | Stephenson | F15B 21/14 60/414 |
| 7,140,178 | B2 | 11/2006 | Bitter | |
| 7,634,911 | B2 * | 12/2009 | Brinkman | E02F 9/2217 60/414 |
| 9,086,061 | B2 * | 7/2015 | Zhang | F15B 21/14 |
| 9,127,437 | B2 * | 9/2015 | Hand | E02F 9/2217 |
| 9,279,236 | B2 * | 3/2016 | Zhang | E02F 9/2217 |
| 10,704,229 | B2 * | 7/2020 | Uemura | F15B 21/14 |
| 10,988,915 | B2 * | 4/2021 | Kang | E02F 9/2217 |
| 2018/0142444 | A1 * | 5/2018 | Kishida | E02F 9/2217 |
| 2018/0148907 | A1 | 5/2018 | Joo et al. | |

* cited by examiner

[Fig. 1]
(Prior Art)
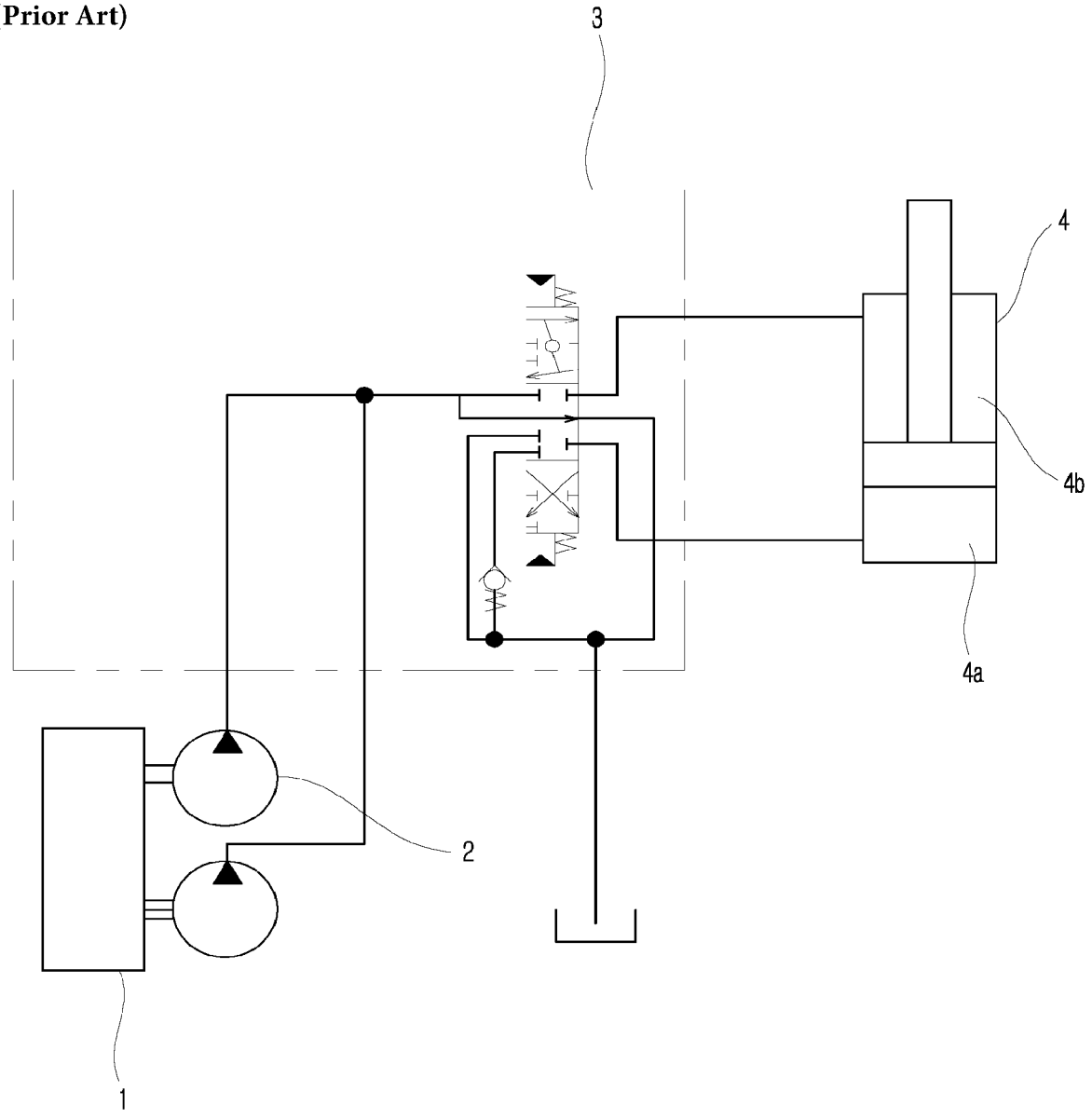

[Fig. 2]
(Prior Art)
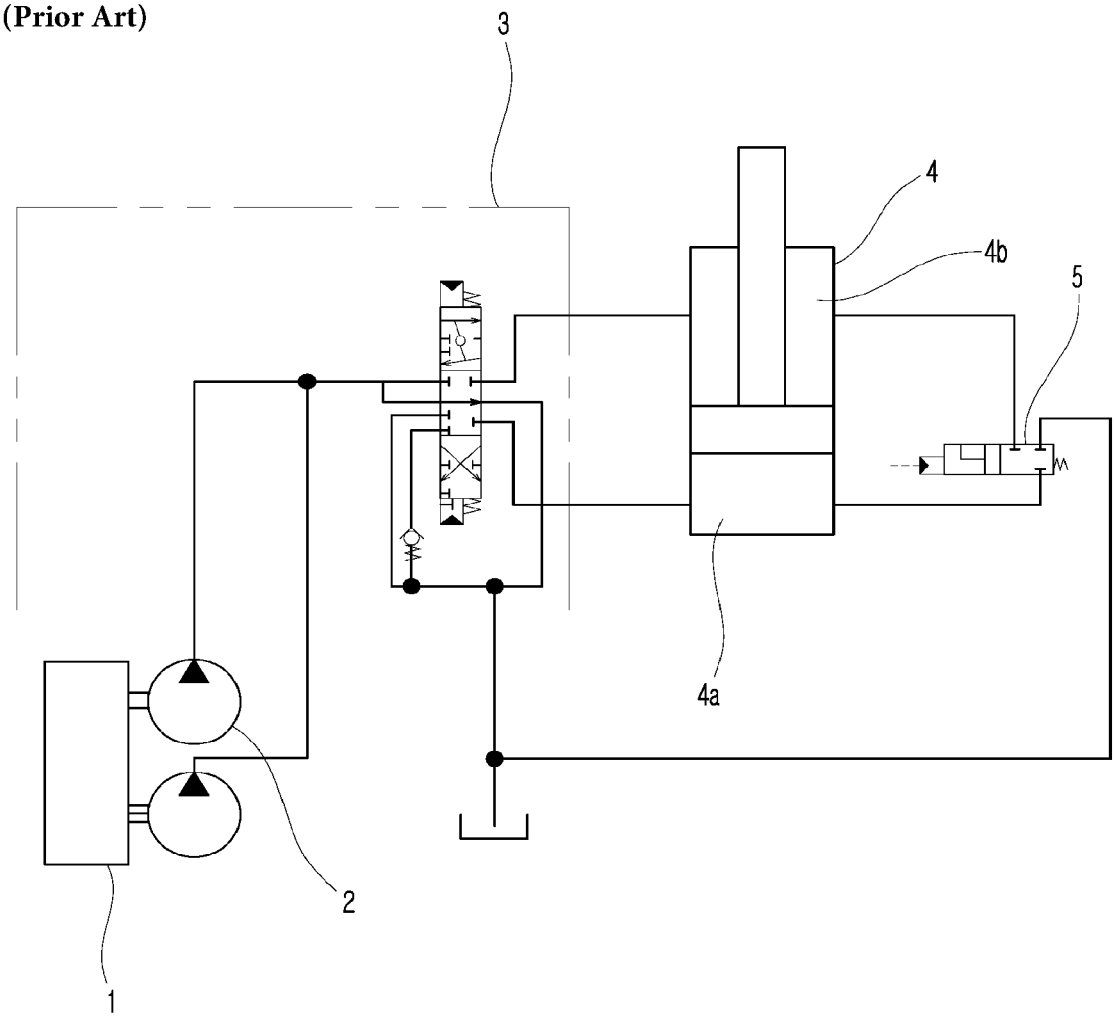

[Fig. 3]
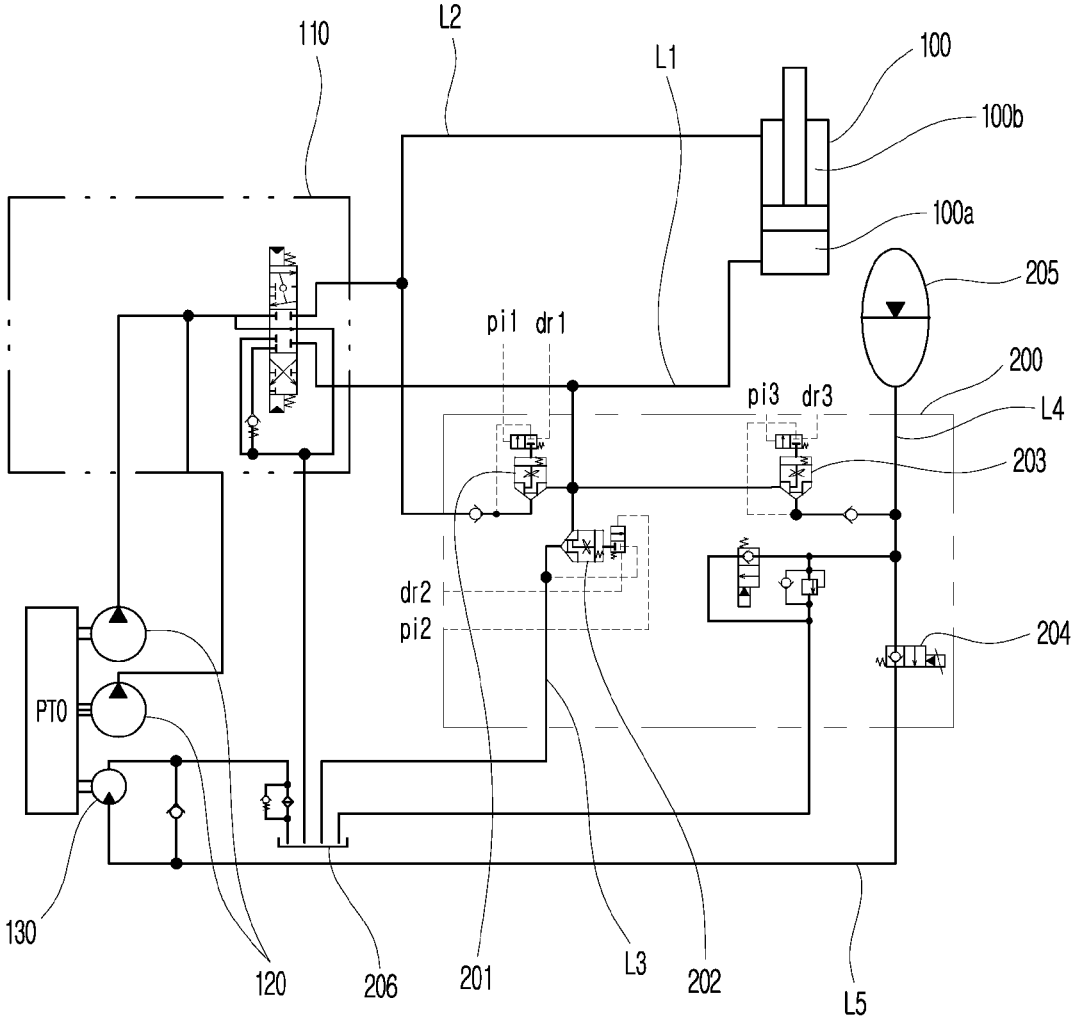

[Fig. 4]
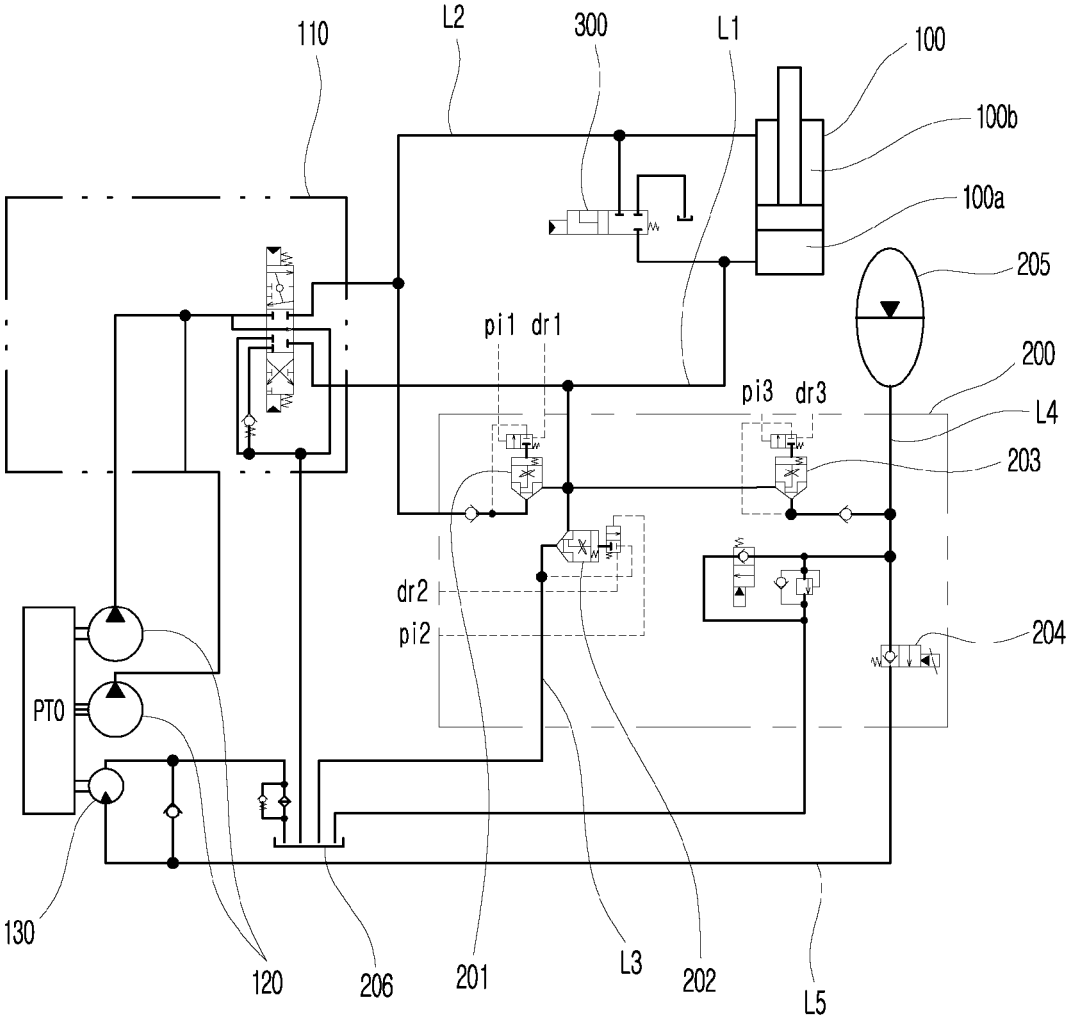

[Fig. 5]
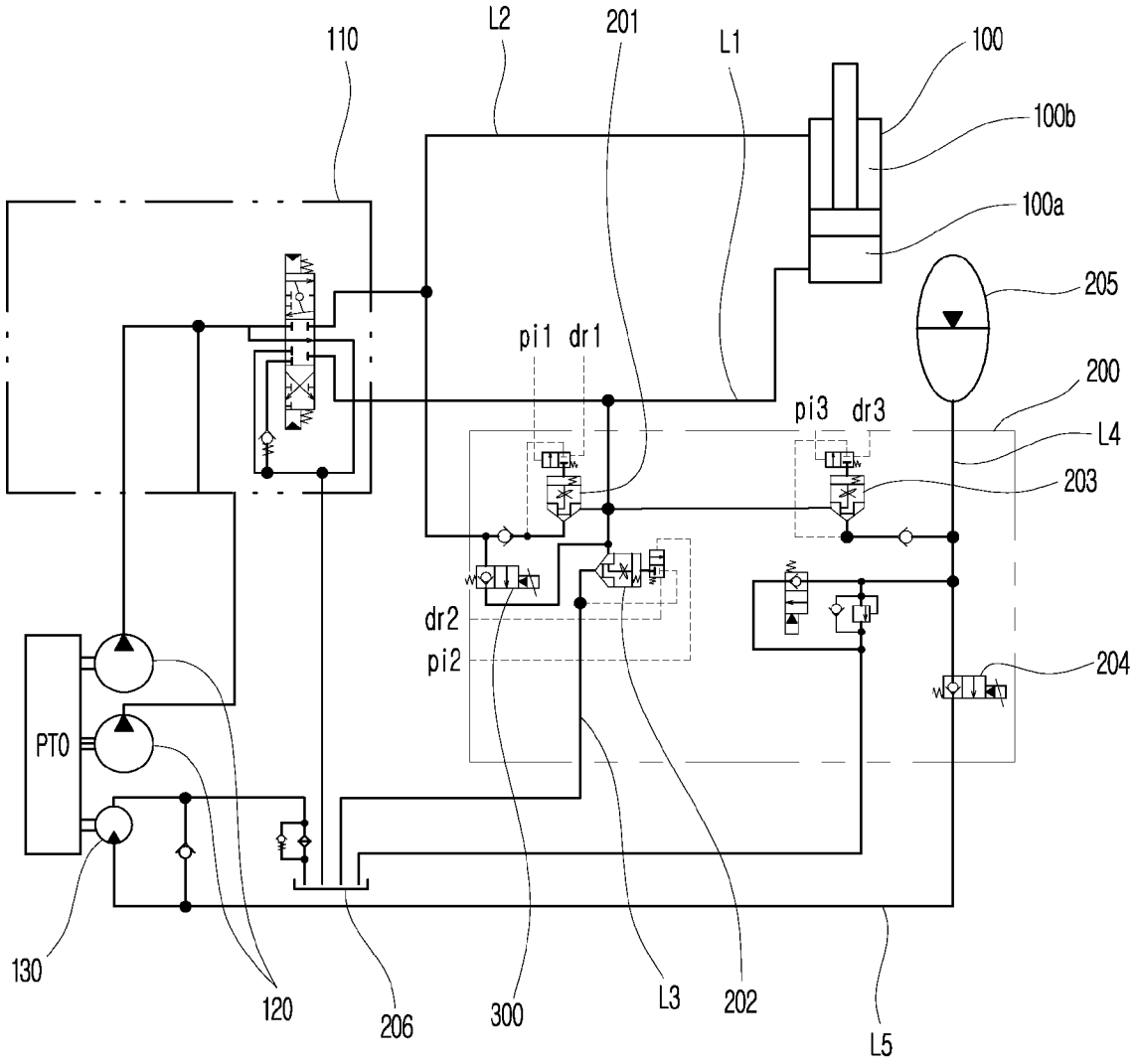

[Fig. 6]
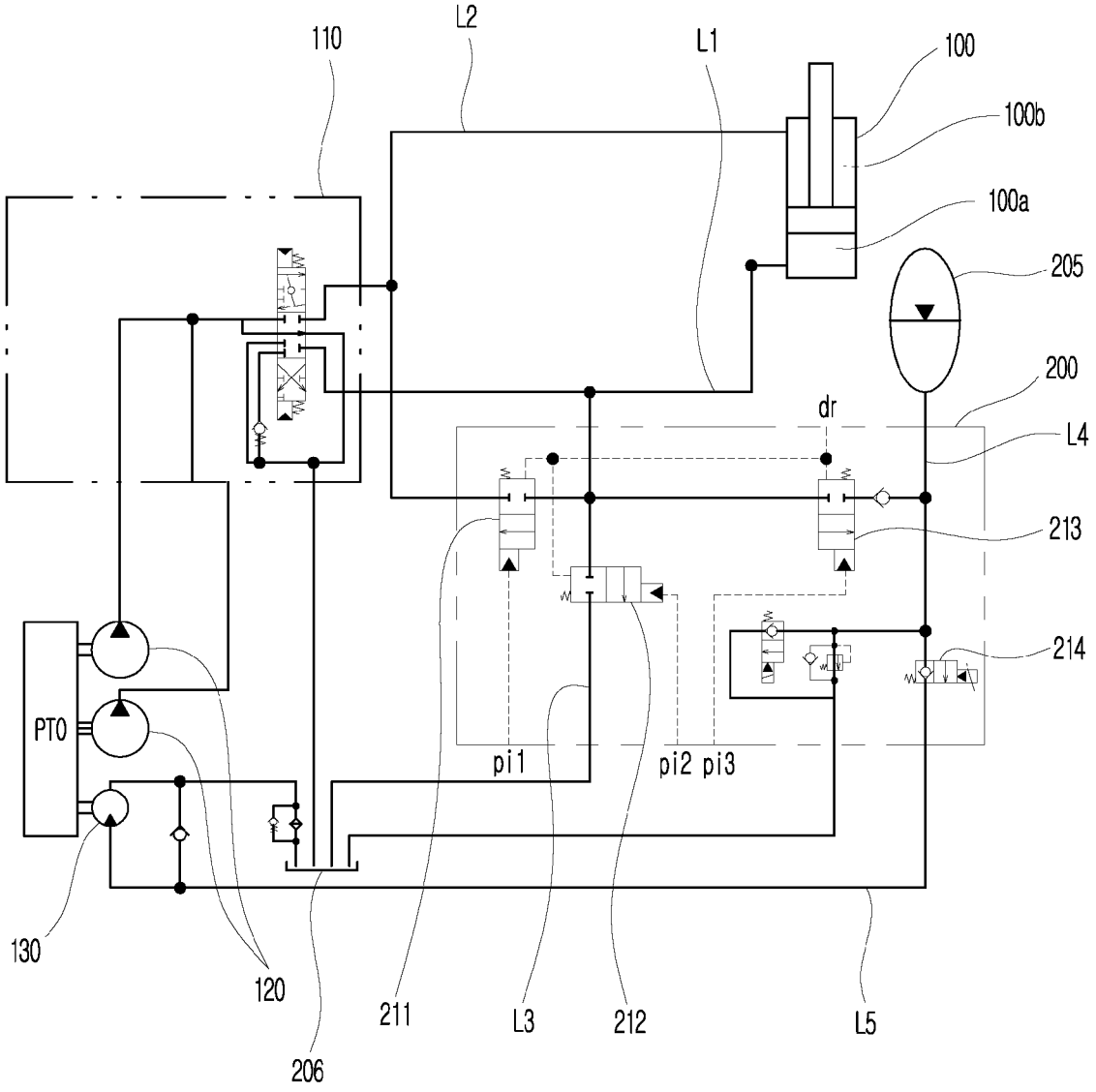

[Fig. 7]
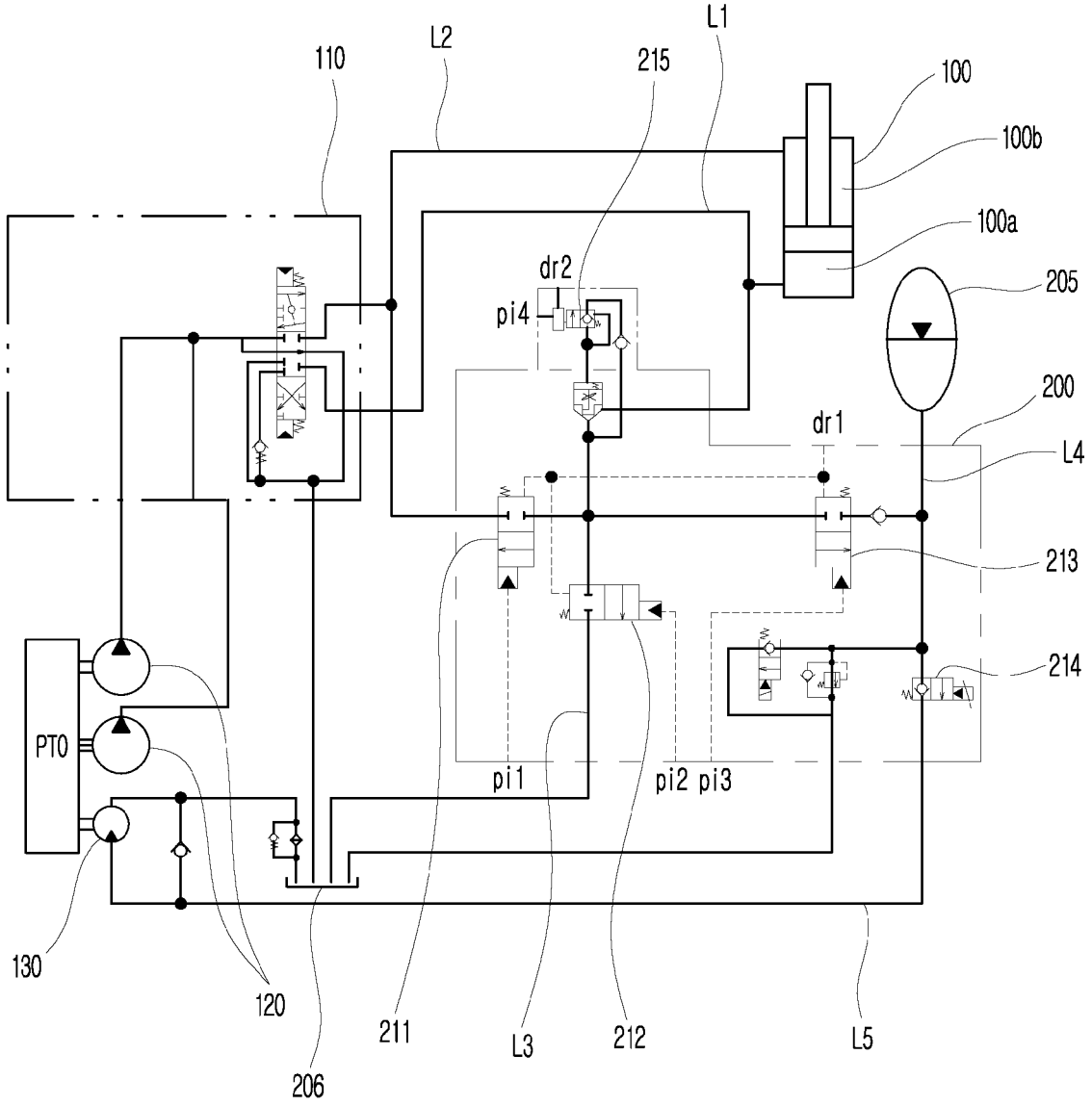

HYDRAULIC CIRCUIT FOR CONSTRUCTION EQUIPMENT

CROSS REFERENCE TO RELATED APPLICATIONS

This application is a 35 U.S.C. § 371 national stage application of PCT International Application No. PCT/KR2018/010094 filed on Aug. 30, 2018, the disclosure and content of which is incorporated by reference herein in its entirety.

TECHNICAL FIELD

The present invention relates to a hydraulic circuit for construction equipment, and more specifically, to a hydraulic circuit for construction equipment capable of increasing energy efficiency by regenerating or recovering return-oil when a boom is lowered.

BACKGROUND ART

Generally, construction equipment generates power using hydraulic pressure.

A working unit of the construction equipment excavates soil or rock or allows the excavated soil or rock to be loaded.

A hydraulic pump is provided to use hydraulic pressure and supplies hydraulic oil to an actuator, which drives the working unit, by pumping oil stored in an oil tank.

In this case, an engine has to be operated in order to operate the hydraulic pump, and fuel has to be consumed in order to operate the engine.

FIG. 1 schematically illustrates a hydraulic circuit of construction equipment according to a conventional art, and as shown in FIG. 1, a main pump 2 is operated using power generated by an engine 1 to generate hydraulic pressure. Hydraulic pressure of the main pump 2 is supplied to a main control valve 3 and is selectively supplied to a large chamber 4*a* or a small chamber 4*b* of a boom cylinder 4 by a hydraulic control of the main control valve 3.

The hydraulic pressure of the main pump 2 is supplied to the main control valve 3 and is selectively supplied to a large chamber 4*a* or a small chamber 4*b* of a boom cylinder 4 by a hydraulic control of the main control valve 3.

In this case, as one method of reducing fuel consumption of construction equipment, when a spool control is performed on the main control valve 3 so that the large chamber 4*a* and the small chamber 4*b* communicate with each other when a boom is lowered, the hydraulic oil discharged from the large chamber 4*a* is supplied to the small chamber 4*b* through the main control valve 3, and thus an energy regeneration function is performed.

In order to decrease fuel consumption of the construction equipment and increase fuel efficiency of construction equipment, an energy generation technology is used.

Further, construction equipment may require a boom floating function.

The boom floating function refers to a function that allows an attachment to be moved vertically along a curved surface of ground due to a weight of a boom even when an operator lowers the boom.

That is, even when an arm moves forward and backward and a boom moves downward, the attachment moves along the curved surface without damaging the curved surface of the ground due to the boom floating function.

Therefore, when the operator changes a mode to a floating mode according to the type of works, the work may stop in a state in which working oil is not supplied from the hydraulic pump, and when in a general excavation mode, the floating mode is canceled, the working oil is supplied from the hydraulic pump, and the work starts. When the work stops in the floating mode, the working oil of the hydraulic pump is not used, and thus efficiency and productivity of work can be increased.

Therefore, FIG. 2 schematically illustrates a configuration in which a float valve is added to a hydraulic circuit of construction equipment according to a conventional art, as shown in FIG. 2. In the case of the construction equipment that requires the above-described floating function, a float valve 5 is disposed between a main control valve 3 and a boom cylinder 4.

In this case, when a float valve 5 is controlled to be opened, a state in which a large chamber 4*a* and a small chamber 4*b* of the boom cylinder 4 directly communicate with each other is maintained, and thus a floating mode is performed.

However, it is necessary for the float valve to be installed in the construction equipment that additionally requires the floating function, and a passage for supplying and controlling hydraulic oil is additionally installed in the float valve, and thus a configuration of the construction equipment becomes complicated, and the volume of the construction equipment is increased.

DISCLOSURE OF INVENTION

Technical Problem

The present invention is directed to providing a hydraulic circuit of construction equipment capable of increasing energy efficiency by regenerating and recovering return-oil when a boom of the construction equipment is lowered and simplifying a configuration thereof.

Solution to Problem

One aspect of the present invention provides a hydraulic circuit of construction equipment including a boom cylinder for controlling up and down operation of a boom, which includes a valve unit having a first control valve configured to control a large chamber of the boom cylinder to selectively communicate with a small chamber of the boom cylinder, a second control valve configured to control the large chamber to selectively communicate with an oil tank, a third control valve configured to control the large chamber to selectively communicate with an accumulator, and a fourth control valve configured to control a part of hydraulic oil flowing to the accumulator to selectively flow to an assist motor.

The hydraulic circuit may further include a first oil line configured to connect the large chamber with the first control valve.

The hydraulic circuit may further include a second oil line configured to connect the first control valve with the small chamber of the boom cylinder.

The hydraulic circuit may further include a third oil line configured to connect the second control valve with an oil tank.

The hydraulic circuit may further include a fourth oil line configured to connect the accumulator with the third control valve.

The hydraulic circuit may further include a fifth oil line configured to connect the fourth control valve with the assist motor.

The hydraulic circuit may further include a float valve disposed between the first oil line and the second oil line to be connected with the first oil line and the second oil line in parallel.

Each of the first to third control valves may be a poppet valve.

Each of the first to third control valves may be a spool valve.

The hydraulic circuit may further include a holding valve disposed in the valve unit and connected with the large chamber of the boom cylinder at an upper stream of a path through which the first to third control valves are connected.

The hydraulic circuit may further include a main control valve interposed between the first oil line and the second oil line.

The hydraulic circuit may further include a main pump for supplying hydraulic oil to the main control valve.

The main pump may be connected with a power take-off (PTO) to receive power.

The assist motor may be connected with the PTO so that power received from the accumulator may be supplied to the PTO.

Advantageous Effects of Invention

According to an embodiment of the present invention, return-oil generated when a boom of construction equipment is lowered is recovered or regenerated, and thus energy efficiency can be increased.

Further, when the construction equipment requires a floating function, a float valve is disposed in a valve unit, and thus a configuration of the construction equipment can be simplified.

It should be understood that effects of the present invention are not limited to the aforementioned effects, and include all of the effects deducible from the detailed description of the present invention or the configuration of the invention described in the claims.

BRIEF DESCRIPTION OF DRAWINGS

FIG. 1 schematically illustrates a hydraulic circuit of construction equipment according to a conventional art.

FIG. 2 schematically illustrates a configuration in which a float valve is added to the hydraulic circuit of the construction equipment according to a conventional art.

FIG. 3 schematically illustrates a hydraulic circuit of construction equipment according to one embodiment of the present invention.

FIG. 4 schematically illustrates a hydraulic circuit of construction equipment according to another embodiment of the present invention.

FIG. 5 schematically illustrates a hydraulic circuit of construction equipment according to still another embodiment of the present invention.

FIG. 6 schematically illustrates a hydraulic circuit of construction equipment according to yet another embodiment of the present invention.

FIG. 7 schematically illustrates a hydraulic circuit of construction equipment according to yet another embodiment of the present invention.

MODE FOR THE INVENTION

Hereinafter, embodiments will be described with reference to the accompanying drawings. However, the embodiments of the present invention may be implemented in several different forms and are not limited to the embodiments described herein. In addition, parts irrelevant to description will be omitted in the drawings to clearly explain the embodiments of the present invention, and similar parts are denoted by similar reference numerals throughout this specification.

Throughout the specification, when an element is referred to as being "connected" to another element, the element may be "directly connected" to another element or the element may be "indirectly connected" to another element through an intervening element. Further, when a portion "includes" an element, the portion may include the element and another element may be further included therein, unless otherwise described.

Hereinafter, embodiments of the present invention will be described in more detail with reference to the accompanying drawings.

FIG. 3 schematically illustrates a hydraulic circuit of construction equipment according to one embodiment of the present invention.

As shown in FIG. 3, the hydraulic circuit of the construction equipment may include a boom cylinder 100 and a valve unit 200.

The boom cylinder 100 may include a piston reciprocating in the cylinder in a longitudinal direction so as to control ascending and descending movement of a boom (not shown) of the construction equipment.

The boom cylinder 100 may be connected with the valve unit 200 through a first oil line L1 connected with the large chamber 100*a*.

The valve unit 200 may include a first control valve 201 opened or closed so that the large chamber 100*a* is selectively connected with the small chamber 100*b*, a second control valve 202 opened or closed so that the large chamber 100*a* is selectively connected with an oil tank 206, a third control valve 203 opened or closed so that the large chamber 100*a* is selectively connected with an accumulator 205, and a fourth control valve 204 opened or closed so that hydraulic oil partially communicating with the accumulator 205 selectively communicates with an assist motor 130.

In this case, each of the first control valve 201, the second control valve 202, and the third control valve 203 may be formed as a poppet valve.

When each of the first control valve 201, the second control valve 202, and the third control valve 203 may be formed as a poppet valve, high airtightness is securable in the oil line, and thus leakage and contamination of the hydraulic oil can be minimized.

Further, the hydraulic circuit may further include a first oil line L1 connecting the large chamber 100*a* with the first control valve 201, a second oil line L2 connecting the first control valve 201 with the small chamber 100*b*, a third oil line L3 connecting the second control valve 202 with the oil tank 206, a fourth oil line L4 connecting the accumulator 205 with the third control valve 203, and a fifth oil line L5 connecting the fourth control valve 204 with the assist motor 130.

Further, the main control valve 110 may be further located between the first oil line L1 and the second oil line L2.

The main control valve 110 may be controlled by the hydraulic oil received from the main pump 120.

Further, the main pump 120 may be disposed to be connected with a power take-off (PTO) in order to receive power. In this case, the assist motor 130 is connected with the PTO to supply power received from the accumulator 205 to the PTO.

Therefore, when the boom is lowered, the valve unit 200 may be controlled without operation of a boom switching valve in the main control valve 110.

Further, when the hydraulic oil discharged from the large chamber 100*a* is regenerated toward the small chamber 100*b* when the boom is lowered, the hydraulic oil in the first oil line L1 is supplied to the second oil line L2 in response to a signal pi1.

When the hydraulic oil of the first oil line L1 is controlled to communicate with the oil tank 206, a second control valve 202 is disposed so that the hydraulic oil of the first oil line L1 is controlled to be supplied to the third oil line L3 in response to a signal pi2, and when the hydraulic oil of the first oil line L1 is controlled to be transferred to and accumulated in the accumulator 205, a third control valve 203 is controlled to be opened so that the hydraulic oil is transferred to the accumulator 205 in response to a signal pi3.

Further, the fourth control valve 204 may control hydraulic oil in the fourth oil line L4 to be transferred to the assist motor 130.

FIG. 4 schematically illustrates a hydraulic circuit of construction equipment according to another embodiment of the present invention.

As shown in FIG. 4, the hydraulic circuit of the construction equipment according to another embodiment of the present invention further includes a float valve 300 communicating with a first oil line L1 and a second oil line L2 in parallel.

In this case, a float valve 300 is installed outside a valve unit 200, and thus a separate passage for hydraulically controlling the float valve 300 should be formed.

The float valve 300 may be disposed to perform a boom floating function.

The boom floating refers to a function that allows an attachment to be moved vertically along a curved surface of ground due to a weight of a boom even when an operator lowers the boom during the work.

That is, when an arm of the construction equipment moves forward and backward and the boom is lowered, the attachment moves along the curved surface without damaging the curved surface of the ground due to a floating function.

Therefore, when the operator changes a mode to the floating mode according to the type of works, the work may stop in a state in which working oil is not supplied from the hydraulic pump, and in a general excavation mode, the floating mode is canceled, the working oil is supplied from the hydraulic pump, and the work is performed.

In this case, when the operator changes a mode to the floating mode to stop the work, the hydraulic oil of the main pump is not used, and thus efficiency and productivity of work can be increased.

FIG. 5 schematically illustrates a hydraulic circuit of construction equipment according to still another embodiment of the present invention.

As shown in FIG. 5, when compared with a configuration of FIG. 4, the hydraulic circuit of the construction equipment according to still another embodiment of the present invention differs in that a float valve 300 is installed in a valve unit 200.

That is, the float valve 300 is disposed parallel to a first oil line L1 and a second oil line L2, but, when the float valve 300 is formed in the valve unit 200, an external configuration for connection with the oil tank 206 may be omitted and a floating function is performed by the first control valve 201 and the float valve 300 even though the float valve 300 is connected with a large chamber 100*a* and a small chamber 100*b*, and thus a separate oil line is omitted, and a structure of the hydraulic circuit can be simplified.

FIG. 6 schematically illustrates a hydraulic circuit of construction equipment according to yet another embodiment of the present invention.

As shown in FIG. 6, in comparison with a configuration of FIG. 3, a configuration of the hydraulic circuit of the construction equipment according to yet another embodiment of the present invention is the same as the configuration in FIG. 3 in terms of that a first control valve 211, a second control valve 212, and a third control valve 213 are formed at the same positions as in FIG. 3, but differs in that each of the first control valve 211, the second control valve 212, and the third control valve 213 is formed as a spool valve.

When the first control valve 211, the second control valve 212, and the third control valve 213 are formed as a spool valve, each of the valves is controlled by a spool of each of the valves, and thus an opening area is continuously changed according to movement of the spool.

Further, when the first control valve 211 is formed as a spool valve, a large chamber 100*a* and a small chamber 100*b* are connected with each other only by movement of the spool of the first control valve 211, and thus a floating function can be performed.

FIG. 7 schematically illustrates a hydraulic circuit of construction equipment according to yet another embodiment of the present invention.

As shown in FIG. 7, the hydraulic circuit of the construction equipment according to yet another embodiment of the present invention further includes a holding valve 215 connected with a large chamber 100*a* of a boom cylinder 100 at an upper stream of a path through which the first control valve 211, the second control valve 212, and the third control valve 213 are connected.

The holding valve 215 functions as a valve that prevents a natural lowering phenomenon (drift) caused by the leakage of working oil at a neutral position of an operation unit, such as a boom, and controls hydraulic oil when an operation device is driven.

Therefore, in the above-described hydraulic circuit of the construction equipment according to one embodiment of the present invention, the first control valve 211 is controlled so that hydraulic oil discharged from the large chamber 100*a* of the boom cylinder 100 communicates with the small chamber 100*b* when the boom is lowered, and thus an energy regeneration function can be performed. When the hydraulic oil discharged from the large chamber 100*a* is accumulated in the accumulator 205 and energy recovery is performed, the third control valve 213 is controlled to be opened, and thus the energy recovery can be performed.

Further, even when a floating function is required, the float valve 300 may be additionally installed in the valve unit 200, and thus complicated installation of a passage configuration and the like due to an external configuration can be omitted unlike a case in which the float valve 300 is installed separately from the valve unit 200, and thus a structure can be simplified and costs can be reduced.

Further, when the first control valve 211 installed in the valve unit 200 is formed to have a spool valve structure, the large chamber 100*a* and the small chamber 100*b* can be connected with each other only by the movement of the spool of the first control valve 211, and thus a floating function can be performed without a separate float valve.

The above description is only exemplary, and it should be understood by those skilled in the art that the present invention may be performed in other concrete forms without changing the technological scope and essential features. Therefore, the above-described embodiments should be considered as only examples in all aspects and not for purposes of limitation. For example, each component described as a single type may be realized in a distributed manner, and similarly, components that are described as being distributed may be realized in a coupled manner.

The scope of the present invention is defined not by the detailed description but by the appended claims, and encompasses all modifications or alterations derived from meanings, the scope and equivalents of the appended claims.

DESCRIPTION OF SYMBOLS

100: BOOM CYLINDER
100*a*: LARGE CHAMBER
100*b*: SMALL CHAMBER
110: MAIN CONTROL VALVE
120: MAIN PUMP
130: ASSIST MOTOR
200: VALVE UNIT
201: FIRST CONTROL VALVE
202: SECOND CONTROL VALVE
203: THIRD CONTROL VALVE
204: FOURTH CONTROL VALVE
205: ACCUMULATOR
L1: FIRST OIL LINE
L2: SECOND OIL LINE
L3: THIRD OIL LINE
L4: FOURTH OIL LINE
L5: FIFTH OIL LINE

INDUSTRIAL APPLICABILITY

According to the present invention, energy regeneration and recovery functions can be performed when a boom of construction equipment is lowered, and thus energy recovering efficiency can be increased.

The invention claimed is:

1. A hydraulic circuit of construction equipment, including a boom cylinder for controlling up and down operation of a boom, the hydraulic circuit comprising a valve unit which has:

a first control valve configured to control a large chamber of the boom cylinder to selectively communicate with a small chamber of the boom cylinder;

a second control valve configured to control the large chamber to selectively communicate with an oil tank;

a third control valve configured to control the large chamber to selectively communicate with an accumulator;

a fourth control valve configured to control a part of hydraulic oil flowing to the accumulator to selectively flow to an assist motor;

a first oil line configured to connect the large chamber with the first control valve;

a second oil line configured to connect the first control valve with the small chamber of the boom cylinder;

a main control valve interposed between the first oil line and the second oil line;

a main pump for supplying hydraulic oil to the main control valve; and a float valve disposed between the first oil line and the second oil line to be connected with the first oil line and the second oil line in parallel.

2. The hydraulic circuit of claim 1, further comprising a third oil line configured to connect the second control valve with the oil tank.

3. The hydraulic circuit of claim 2, further comprising a fourth oil line configured to connect the accumulator with the third control valve.

4. The hydraulic circuit of claim 3, further comprising a fifth oil line configured to connect the fourth control valve with the assist motor.

5. The hydraulic circuit of claim 1, wherein each of the first to third control valves is a poppet valve.

6. The hydraulic circuit of claim 1, wherein the main pump is connected with a power take-off (PTO) to receive power.

7. The hydraulic circuit of claim 6, wherein the assist motor is connected with the PTO so that power received from the accumulator is supplied to the PTO.

* * * * *